US006073824A

United States Patent [19]

Gray et al.

[11] Patent Number: 6,073,824

[45] Date of Patent: Jun. 13, 2000

[54] APPARATUS AND METHOD FOR CLEANLY BREAKING A CONTINUOUSLY ADVANCING CELLULOSE WEB

[75] Inventors: Robert Lee Gray, Augusta; Richard Ames Horton, Martinez, both of Ga.

[73] Assignee: Kimberly-Clark Worldwide, Inc., Neenah, Wis.

[21] Appl. No.: 09/272,728

[22] Filed: Mar. 22, 1999

[51] Int. Cl.[7] ..... B65H 19/20

[52] U.S. Cl. ..... 225/2; 162/194; 162/286; 225/95; 242/521; 242/522; 242/533.3; 242/531

[58] Field of Search ..... 225/2, 94, 96, 225/106; 162/286, 255, 193, 194; 242/533, 533.2, 526.1, 524, 523.1, 523, 533.3, 521, 522, 531; 83/177

[56] References Cited

U.S. PATENT DOCUMENTS

| | | | |
|---|---|---|---|
| 3,813,052 | 5/1974 | Swann et al. | 242/554.5 |
| 3,869,095 | 3/1975 | Diltz | 242/533.3 |
| 3,880,374 | 4/1975 | Reiser | 242/531 |
| 4,087,319 | 5/1978 | Linkletter | 162/283 |
| 4,182,170 | 1/1980 | Grupp | 83/177 |
| 4,302,282 | 11/1981 | Young | 162/281 |
| 4,491,503 | 1/1985 | Adams et al. | 162/255 |
| 4,552,316 | 11/1985 | Dropczynski | 242/56 R |
| 4,962,897 | 10/1990 | Bradley | 242/533.2 |
| 5,037,509 | 8/1991 | Wedel | 162/286 |
| 5,092,533 | 3/1992 | Gangemi | 242/56.8 |
| 5,346,150 | 9/1994 | Volin | 242/531 |
| 5,622,601 | 4/1997 | Adams et al. | 162/255 |
| 5,762,759 | 6/1998 | Wedel | 162/255 |
| 5,810,280 | 9/1998 | Ryan et al. | 242/523.1 |
| 5,879,515 | 3/1999 | Straub et al. | 162/286 |

*Primary Examiner*—Sean Pryor
*Attorney, Agent, or Firm*—Patricia A. Charlier; Thomas J. Connelly

[57] ABSTRACT

An apparatus and method for cleanly breaking a continuously advancing cellulose web includes a transfer fabric which supports and advances the cellulose web to a wind up zone. The transfer fabric forms a closed loop and is driven at a desired speed by a drive roll. At least two spray nozzles are arranged transversely across the advancing cellulose web as it is carried on the transfer fabric. The spray nozzles are capable of emitting a liquid under high pressure against the advancing cellulose web to form perforations across the width thereof. A plurality of hollow cores are independently and sequentially moved into position at the wind up zone to receive the advancing cellulose web. The hollow cores are located downstream of the spray nozzles and each hollow core is capable of accumulating a predetermined amount of the cellulose web. The apparatus further includes controls for activating the spray nozzles in timed sequence to the speed of the transfer fabric such that a predetermined amount of cellulose web can be accumulated on each hollow core to form a finished roll having a predetermined diameter. An assembly is also present for moving each of the finished rolls away from the advancing cellulose web while simultaneously moving a second hollow core into contact with the advancing cellulose web upstream of the finished roll. The contact by the second hollow core and the employment of vacuum increases the tension on the advancing cellulose web and causes the advancing cellulose web to cleanly break at the perforations and form a leading edge. A vacuum is then applied to the second hollow core which causes the leading edge of the advancing cellulose web to wrap onto it. The method encompasses the sequential steps required to break the advancing cellulose web using the above-identified apparatus.

20 Claims, 4 Drawing Sheets

APPARATUS AND METHOD FOR CLEANLY BREAKING A CONTINUOUSLY ADVANCING CELLULOSE WEB

FIELD OF THE INVENTION

This invention relates to an apparatus and method for cleanly breaking a continuously advancing cellulose web. More specifically, this invention relates to an apparatus and method for cleanly breaking a continuously advancing cellulose web with a high pressure liquid.

BACKGROUND OF THE INVENTION

In the production of a cellulose web, such as on a tissue machine, it is common practice to transfer the newly formed cellulose web onto a transfer fabric and route the cellulose web to a wind up zone. At the wind up zone, the cellulose web is wound onto a hollow core into a finished roll having a predetermined outer diameter. The hollow core is usually formed as an elongated cylinder which is made from thick cardboard and is held in place by a reel spool. Once the cellulose web has been wound up on the first hollow core to a desired outside diameter, the cellulose web coming off the machine is cut in the cross-direction and the leading edge is directed onto a second hollow core so that another finished roll can be formed. In the past, it was common to slit a tail for thread up. The finished roll would then be removed and a second hollow core would be properly positioned to receive the oncoming cellulose web. The leading edge of the cellulose web would be wrapped around the periphery of the second hollow core to form another finished roll. This intermittent procedure would be repeated until the newly formed cellulose web had been wound into a multitude of finished rolls.

As technology advanced and production speeds increased, it no longer became acceptable to stop the advancing cellulose web so that it could be cut and separated from the oncoming web. One way this was accomplished was to physically withdraw the finished roll from the advancing cellulose web and create a differential tension across the web which caused it to break or tear. A second hollow core was then positioned in place to receive the oncoming web. However, the torn web would exhibit a ragged or jagged edge which could extend in the machine direction from between about 1 to about 50 feet due to the high operating speeds of the tissue machine. This was disadvantageous for a number of reasons. First, pieces of cellulose web, known as "trash", commonly broke off from the advancing cellulose web during the tearing process and would fly about the machine and accumulate on the floor. This required additional maintenance and presented a safety hazard. Second, the ragged edge tended to complicate the attachment of the leading edge onto the second hollow core. If the tear extended over several feet, it also tended to cause the cellulose web to wind up on the hollow core in a non-uniform manner and under varying tension such that problems could be encountered in the converting area when the web was being unwound.

Therefore, there is a recognized need for an apparatus and a method for quickly and cleanly breaking an advancing cellulose web in the cross-direction so that it can be wrapped evenly onto another hollow core.

SUMMARY OF THE INVENTION

Briefly, this invention relates to an apparatus and method for cleanly breaking a continuously advancing cellulose web is disclosed. The apparatus includes a transfer fabric which supports and advances the cellulose web to a wind up zone. The transfer fabric forms a closed loop and is driven at a desired speed by a drive roll. At least two spray nozzles are arranged transversely across the advancing cellulose web as it is carried on the transfer fabric. The spray nozzles are capable of emitting a liquid under high pressure against the advancing cellulose web to form perforations across the width thereof. A plurality of hollow cores are independently and sequentially moved into position at the wind up zone to receive the advancing cellulose web. The hollow cores are located downstream of the spray nozzles and each hollow core is capable of accumulating a predetermined amount of the cellulose web. The apparatus further includes controls for activating the spray nozzles in timed sequence to the speed of the transfer fabric such that a predetermined amount of cellulose web can be accumulated on each hollow core to form a finished roll having a predetermined diameter. An assembly is also present for moving each of the finished rolls away from the advancing cellulose web while simultaneously moving a second hollow core into contact with the advancing cellulose web upstream of the finished roll. The contact of the advancing cellulose web by the second hollow core increases the tension between the first hollow core, which supports the finished roll, and causes the advancing cellulose web to cleanly break at the perforations and form a leading edge. A vacuum is then applied to the second hollow core which causes the leading edge of the advancing cellulose web to wrap onto it.

The method encompasses the sequential steps required to break the advancing cellulose web using the above-identified apparatus.

The general object of this invention is to provide an apparatus and method for cleanly breaking a continuously advancing cellulose web. A more specific object of this invention is to provide an apparatus and method for cleanly breaking a continuously advancing cellulose web with a high pressure liquid.

Another object of this invention is to provide an apparatus and method for quickly and cleanly breaking a continuously advancing cellulose web in the cross-direction on a web forming machine.

A further object of this invention is to provide an apparatus and method for reducing cellulose trash associated with tearing or breaking a continuously advancing cellulose web coming off of a tissue machine.

Still another object of this invention is to provide an apparatus and method for cleanly breaking a continuously advancing cellulose web such that it improves the likelihood that the leading edge can be efficiently threaded onto a new hollow core.

Still further, an object of this invention is to provide an apparatus and method for cleanly breaking a continuously advancing cellulose web while it is being transported on a fabric without ruining the fabric.

Still another object of this invention is to provide an apparatus and method for cleanly breaking a continuously advancing cellulose web in such a fashion that it improves the roll structure of the cellulose web which is accumulated on a hollow core and avoids problems as the cellulose web is later unwound in a converting department.

Other objects and advantages of the present invention will become more apparent to those skilled in the art in view of the following description and the accompanying drawings.

DETAILED DESCRIPTION OF THE PREFERRED EMBODIMENT

Figure 1:
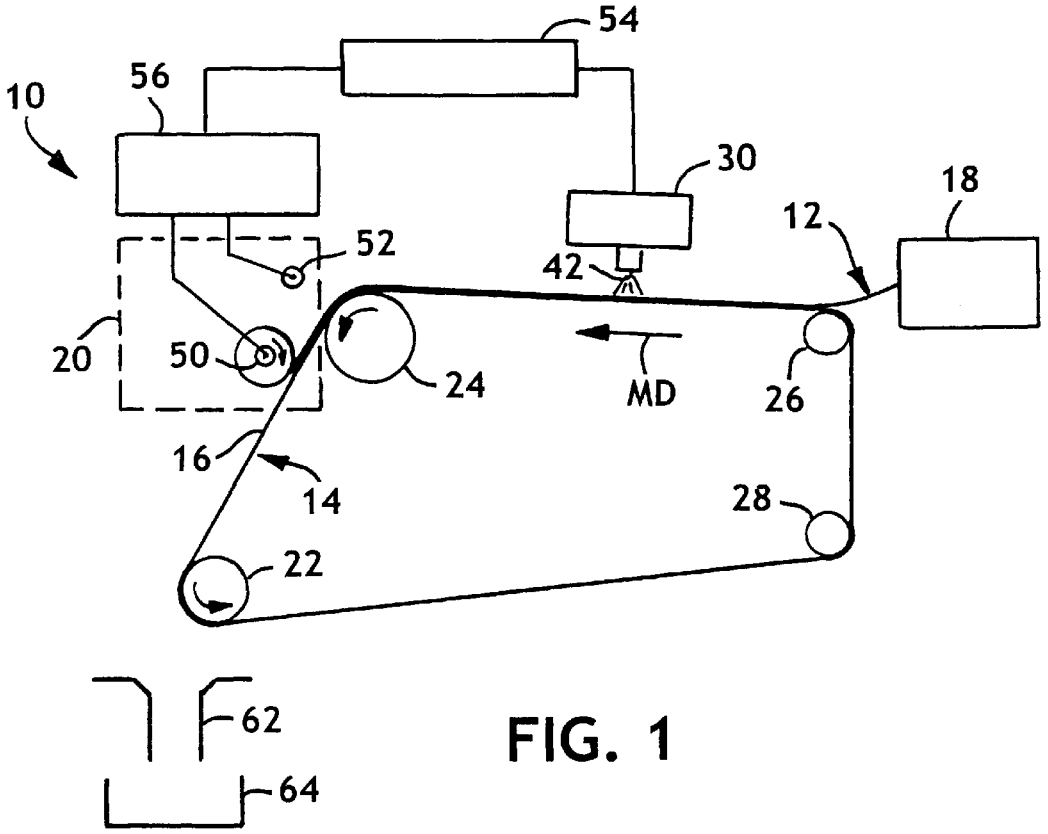
FIG. 1 is a schematic representing a continuously advancing cellulose web carried by a transfer fabric to a wind up zone and depicting spray nozzles positioned upstream of the hollow core which intermittently spray a high pressure liquid onto the cellulose web and form perforations therein.

Referring to FIG. 1, an apparatus 10 is shown for cleanly breaking a continuously advancing cellulose web 12. The apparatus 10 includes a transfer fabric 14 having an outer surface 16. The transfer fabric 14 can be constructed out of natural or synthetic fibers and should exhibit good dimensional stability, wear characteristics and drainage rates. Typical materials used today to construct transfer fabrics 14 include polyethylene fibers, polypropylene fibers and blends thereof. The transfer fabric 14 is formed as a continuous closed loop structure which functions to convey the cellulose web 12 from an upstream location 18 to a wind up zone 20. The transfer fabric 14 is driven by a drive roll 22 and follows a predetermined path around a reel drum 24 and one or more guide rolls. Two guide rolls, 26 and 28 respectively, are depicted for illustration purposes only.

The transfer fabric 14 can be driven at a constant speed or it can be driven at a variable speed. The speed of the transfer fabric 14 will be determined by the type of equipment used, the kind of cellulose web 12 being formed and by the output of the machinery located upstream thereof. The cellulose web 12 can vary in structure and texture depending upon its ultimate use. The cellulose web 12 could be used to produce bathroom tissue, facial tissue, towels, writing paper, packaging paper, etc. In the production of bathroom tissue, the transfer fabric 14 can be operated at a speed of from between about 1,000 feet per minute to about 6,000 feet per minute, preferably, from between about 2,000 feet per minute to about 5,000 feet per minute, and most preferably, from between about 3,000 feet per minute to about 5,000 feet per minute. When the transfer fabric 14 is used to support a cellulose web 12 which will be used to make bathroom tissue, the speed of the transfer fabric 14 should be at least about 3,500 feet per minute.

When the cellulose web 12 is to be used for bathroom tissue, it will have a thickness "t" of from between about 0.02 inches to about 0.07 inches (about 0.25 mm to about 1.8 mm), preferably, a thickness "t" of from between about 0.02 inches to about 0.05 inches (about 0.5 mm to about 1.3 mm), and most preferably, a thickness "t" of from between about 0.03 inches to about 0.04 inches (about 0.76 mm to about 1 mm).

It should be noted that the cellulose web 12 can be advanced by the transfer fabric 14 while being retained at an elevated temperature. Especially in forming bathroom tissue, the cellulose web 12 coming off a Yankee dryer or a throughdryer can be at a temperature of at least about 100° F., preferably at a temperature of at least about 125° F., and most preferably, at a temperature of above about 150° F.

Figure 2:
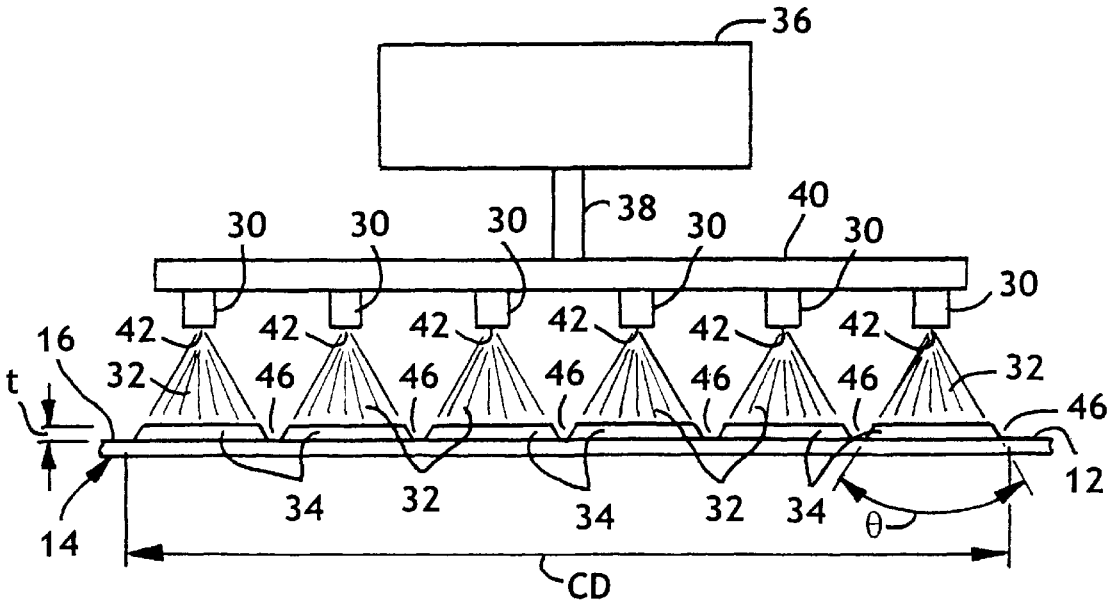
FIG. 2 is a side view of a plurality of spray nozzles positioned across the width of a continuously advancing cellulose web.

Referring to FIGS. 1 and 2, the apparatus 10 also includes at least two and preferably a plurality of spray nozzles 30 arranged transversely across the width "w" of the cellulose web 12. The spray nozzles 30 are designed to emit a liquid 32 under high pressure against the continuously advancing cellulose web 12 and form perforations 34 through the thickness "t" of the cellulose web 12. The spray nozzles 30 can be arranged in a straight line which is aligned in the cross-direction (CD) of the cellulose web 12. The cross-direction (CD) is aligned perpendicular to the machine-direction (MD) which represents the direction of travel of the cellulose web 12 as it is carried on the transfer fabric 14.

The spray nozzles 30 are connected to a source 36 of high pressure liquid 32 via one or more conduits. Two conduits, 38 and 40 respectively, are depicted for illustration purposes only. The liquid 32 can be water, an aqueous solution containing certain additives or a chemical solution designed to facilitate the formation of the perforations 34 in the continuously advancing cellulose web 12. Water is the preferred liquid for it is inexpensive, can be easily recycled and reused and is readily available. The temperature of the water can be controlled to provide optimal performance for the type of cellulose web 12 being broken. For some kinds of cellulose webs 12, heated liquid may be beneficial but for most applications, room temperature liquid works just fine.

The liquid 32 is ejected or emitted out of the spray nozzles 30 at a high pressure. By high pressure, it is meant a pressure above 500 pounds per square inch (psi), preferably, a pressure of from between about 500 psi to about 3,000 psi, most preferably, a pressure of from between about 1,000 psi to about 2,000 psi, and even more preferably, a pressure of about 1,200 psi. It should be noted that the pressure of the liquid can vary depending upon the thickness "t" of the cellulose web 12, the speed of the cellulose web 12, the type of liquid 32 used, the distance the spray nozzles 30 are spaced away from the cellulose web 12, the type of equipment utilized and the spray pattern of the liquid 32 exiting the spray nozzles 30.

Each of the spray nozzles 30 contains an orifice 42 through which the high pressure liquid exits. The size and shape of the orifice 42 will dictate the spray pattern of the liquid emanating from the spray nozzle 30. It should be noted that a variety of sizes and shapes can be used to perforate the advancing cellulose web 12. Actual testing has shown that when perforating a cellulose web 12 which will be used to make bathroom tissue, an orifice 42 having a diameter of from between about 0.01 inches to about 0.1 inches (about 0.25 mm to about 2.5 mm) works well. An orifice 42 having a diameter of at least about 0.04 inches (about 1 mm) works even better and a diameter of at least about 0.05 inches (about 1.3 mm) works best.

Still referring to FIG. 2, the angle theta ($\theta$) at which the liquid 32 exits the orifice 42 is also of importance. This angle $\theta$ should be at least about 90 degrees, preferably, the angle $\theta$ should be at least about 100 degrees, and most preferably, the angle $\theta$ should be at least about 110 degrees. The spray pattern of the liquid 32 can also be controlled and it has been found that a flat jet works best. Spray nozzles 30 can be purchased from various vendors which can also supply technical information on orifice size, spray patterns and liquids which can be used with their equipment. On such supplier of spray nozzles 30 is Spraymation, Inc. having an office at 5320 NW 35 Avenue, Fort Lauderdale, Fla. 33309-6314.

The distance which the spray nozzles 30 are spaced away from the continuously advancing cellulose web 12 is likewise important. For good results, the spray nozzles 30 should be situated from between about 1 inch to about 5 inches (about 25.4 mm to about 127 mm) away from the upper surface of the cellulose web 12. Preferably, the spray nozzles 30 should be situated at least about 2 inches (about 51 mm), and more preferably, at least about 3 inches (about 76 mm) away from the upper surface of the cellulose web 12. The spray nozzles 30 should be arranged such that the high pressure liquid spray impacts the continuously advancing cellulose web 12 at an angle of 90 degrees. Another way of stating this is to say that the high pressure liquid spray perpendicularly contacts the moving cellulose web 12. The individual spray nozzles 30 can be spaced apart from one another a set distance which will partially be dependent on the spray pattern emanating from the orifice 42. The spray nozzles 30 can be spaced apart from one another by a distance of from between about 3 inches (about 76 mm) to about 12 inches (about 305 mm). Preferably, the spray nozzles 30 will be spaced apart from one another by a distance of from between about 5 inches (about 127 mm) to about 10 inches (about 254 mm).

Figure 3:
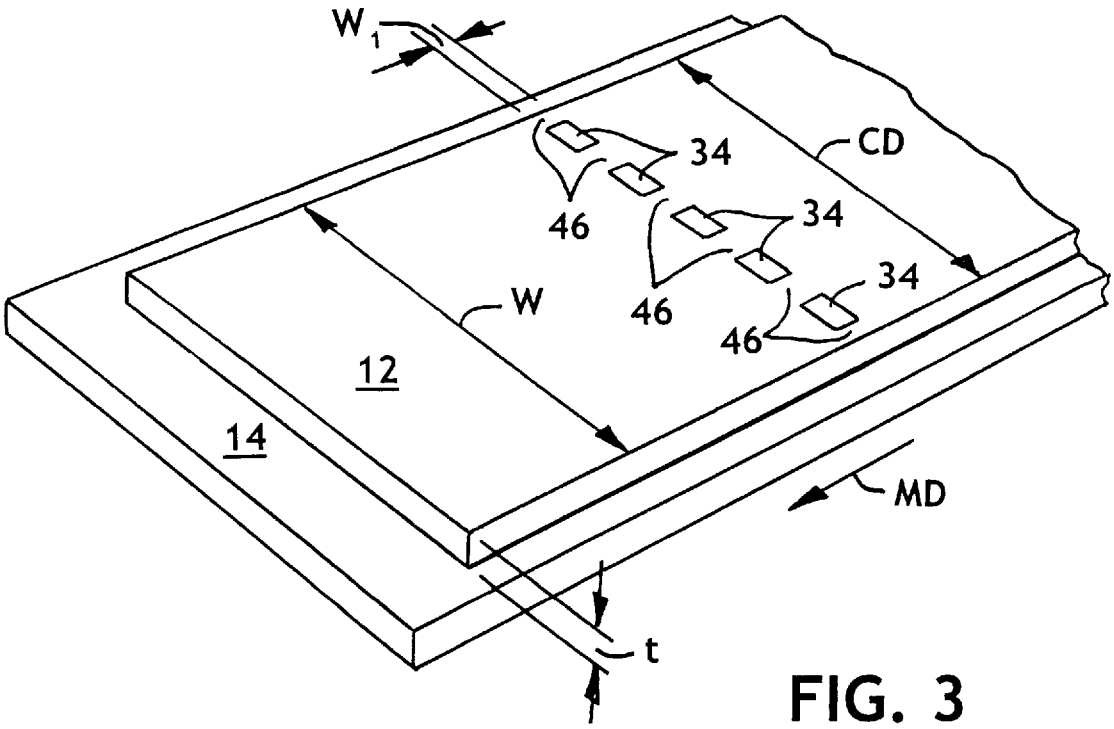
FIG. 3 is a perspective view of a transfer fabric supporting a cellulose web having perforations formed therethrough.
Figure 4:
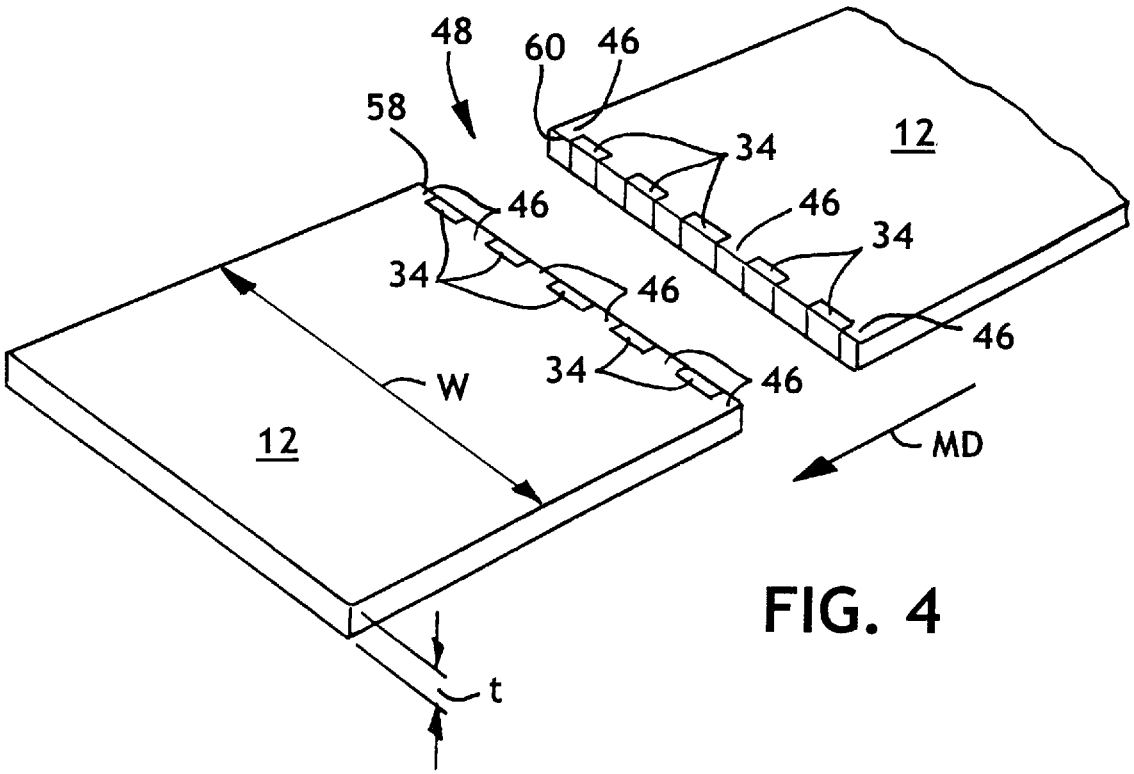
FIG. 4 is a perspective view of a cellulose web having been broken at the line of perforations.

Referring to FIGS. 2–4, the cellulose web 12 is shown having a line of perforations 34 formed across the width "w" thereof in the cross-direction. Each perforation 34 is separated by a land area 46 which is much smaller in length than the length of the adjacent perforations 34. For example, if the perforations 34 have a length of from between about 3 inches to about 12 inches (about 76 mm to about 305 mm), then the land areas 46 should have a length of from between about 1 inch to about 8 inches (about 25 mm to about 203 mm). Preferably, the land areas 46 have a length which is at least 30 percent less than the length of the perforations 34. Most preferably, the land areas 46 will have a length which is at least 50 percent less than the length of the perforations 34. The reason for making the land areas 46 of a lesser length is that these areas will have to be broken by tension downstream of the spray nozzles 34. The less material which is holding the cellulose web 12 together will mean that a smaller force is required to separate the web 12. Another advantage of making the land areas 46 small in size is that a cleaner break can be accomplished.

As clearly seen in FIG. 2, the land areas 46 tend to be V shaped in configuration because the high pressure liquid 32 is flaring out as it exits the orifice 42 of the spray nozzles 30. This V shape profile is beneficial in that it reduces the amount of material in the land areas 46 which needs to be broken downstream. Less material equate to a smaller tensile force needed to accomplish the break.

Directing our attention to FIG. 3, one will note that the width "$w_1$" of each of the perforations 34 in the machine direction will vary depending upon the speed of the advancing cellulose web 12, the pressure and direction of impact of the high pressure liquid 32, and the distance the spray nozzles 30 are spaced away from the upper surface of the cellulose web 12, along with other factors. When the cellulose web 12 is being carried by the transfer fabric 14 at a speed of about 3,500 feet per minute in the machine direction, the width "$w_1$" of the perforations 34 in the machine direction can vary from between about 1 inch to about 10 inches (about 25 mm to about 254 mm). Preferably, the width "$w_1$" of the perforations 34 will be less than about 7 inches (about 178 mm), and most preferably, the width "$w_1$" of the perforations 34 in the machine direction will be less than about 5 inches (about 127 mm). It is advantageous to keep the width "$w_1$" of the perforations 34 to a minimum for it decreases the likelihood of having long strands of fibers extending out from the location of the break 48, see FIG. 4.

The width "$w_1$" of the perforations 34 can also be controlled by the amount of time the spray nozzles 30 are actually operated. It is contemplated that the spray nozzles 30 will be fired for a very short period of time. Typically, the spray nozzles 30 can operate for a period of from between about 0.001 seconds to about 0.1 seconds. Preferably, the spray nozzles 30 can operate for a period of from between about 0.01 seconds to about 0.05 seconds. Most preferably, the spray nozzles 30 can operate for a period of about 0.01 seconds. The shorter the time period in which high pressure liquid 32 is exiting the orifices 42 of the spray nozzles 30, the smaller will be the width "$w_1$" of the perforations 34.

Returning to FIG. 1, the apparatus 10 also includes a plurality of hollow cores 50 which are independently and sequentially movable into position at the wind up zone 20 to receive the advancing cellulose web 12. The hollow cores 50 are reusable, elongated cylinders generally constructed out of thick cardboard and having a length approximately equal to or greater than the width "w" of the cellulose web 12. The hollow cores 50 are retained on a reel spool (not shown) which passes through the center of the hollow core 50 and which is tightly held thereto by means of an inflatable bladder. The reel spool is designed to drive and rotate the hollow core 50 in a predetermined direction so as to accumulate the advancing cellulose web 12. The hollow cores 50 are located downstream from the spray nozzles 30 and preferably are aligned adjacent to the reel drum 24. Each hollow core 50 is designed to accumulate a predetermined amount of the cellulose web 12. When the outer diameter of the cellulose web 12 wrapping around the hollow core 50 reaches a predetermined value, the cellulose web 12 will be broken or cut across its width "w" and the filled spool will be removed. As a second hollow core 52 is moved into contact with the advancing cellulose web 12, a vacuum (not shown ) is applied which causes the leading edge of the cellulose web 12 to wrap onto the second hollow core 52. A second roll will then start to form on the second hollow core 52. This procedure is repeated as long as cellulose web 12 is advancing on the transfer fabric 14.

In order to form a clean break at the line of perforations 34, it is necessary to have a controller 54 which activates the spray nozzles 30 in timed sequence to the speed of the transfer fabric 14. The spray nozzles 30 will be operated based upon a predetermined outside diameter of the filled or finished roll of cellulose web 12 which one desires to have accumulated on the hollow core 50. This outside diameter of the roll of cellulose web 12 can be entered into the controller 54 on an intermittent or continuous basis, if desired. For example, the outside diameter of the roll of cellulose web 12 can be monitored by optical sensors or other commercially available mechanisms known to those skilled in the art. When the roll of cellulose web 12 is almost filled to capacity, a signal is sent to the controller 54 which actuates the spray nozzles 30 so that a line of perforations 34 are formed through the advancing cellulose web 12 at a location which will represent the end or tail of the cellulose web 12 accumulated on the hollow core 50.

In timed relationship to the formation of the perforations 34, the controller 54 will send a signal to an assembly 56. The assembly 56 can include a carriage and hydraulic components which are designed to hold the filled roll 50 and the second hollow core 52. The assembly 56 will start to remove the first filled roll 50 away from the advancing cellulose web 12 while simultaneously moving the second hollow core 52 into contact with the advancing cellulose web 12. The second hollow core 52 will be positioned upstream of the filled roll 50. As the second hollow core 52 contacts the advancing cellulose web 12, the tension in the cellulose web 12 will increase between the filled roll 50 and the second hollow core 52. This increased tension causes the advancing cellulose web 12 to cleanly break at the line of perforations 34 formed in the cross-direction.

Figure 5:
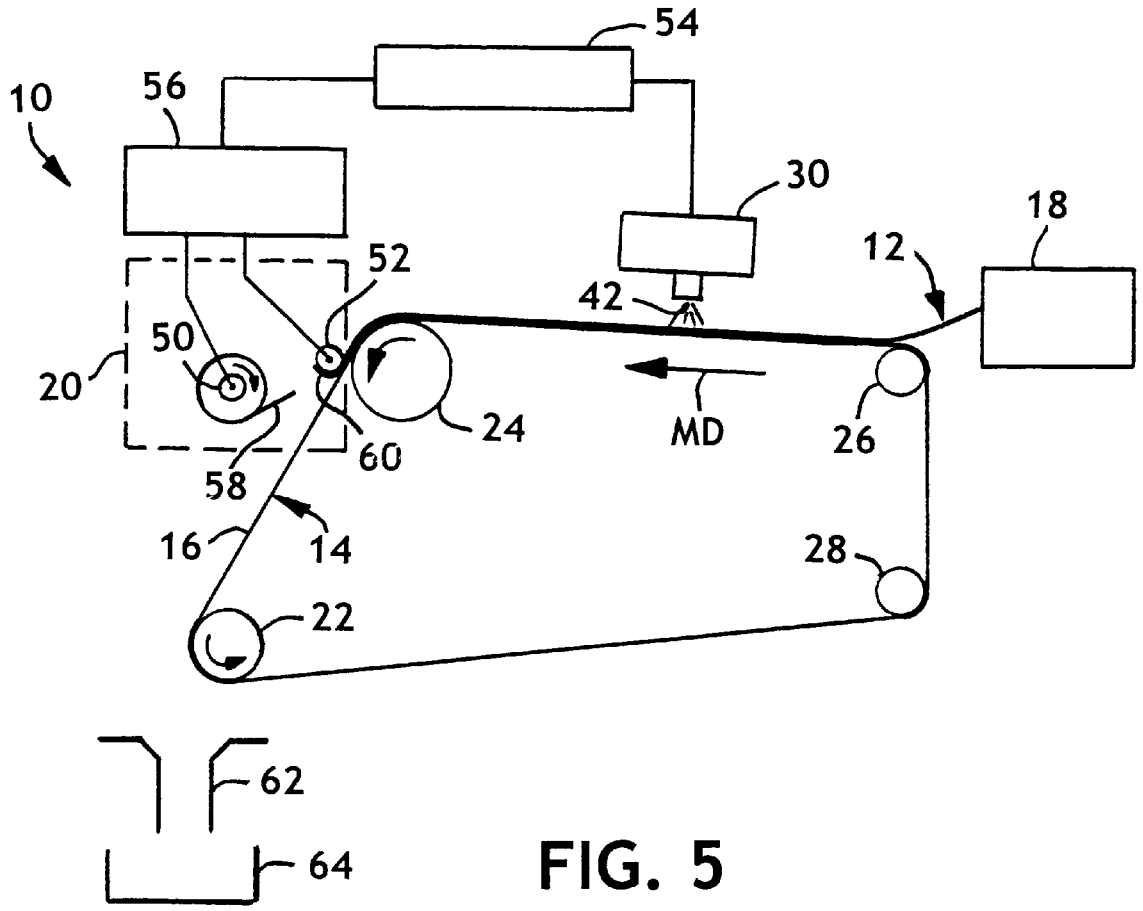
FIG. 5 is a schematic representing a second hollow core contacting the cellulose web while the first filled core is being removed thus creating increased tension such that the cellulose web breaks at the perforations formed by the high pressure liquid.

Referring to FIGS. 4 and 5, the break creates a trailing edge 58 and a leading edge 60. The trailing edge 58 will continue onto the filled roll 50 while the leading edge 60 is brought into contact with the second hollow core 52. One way to urge the leading edge 60 toward the second hollow core 52 is to use a vacuum. A plurality of small holes or apertures can be formed in the periphery of the hollow core and a vacuum is created and routed through the reel spool. This vacuum causes the leading edge 60 to move onto the second hollow core 52 and, as the second hollow core 52 is rotated by the reel spool, the advancing cellulose web 12 will wrap around this core 52. The assembly 56 can then adjust the exact position of the second hollow core 52 so that it occupies the position which the first hollow core 50 vacated.

The apparatus 10 also has a funnel 62 situated below the transfer fabric 14 for directing broke or short pieces of cellulose web 12 which are not to be used. The funnel 62 directs this scrap into a hopper 64 so that it can be collected and eventually recycled.

METHOD

Figure 6:
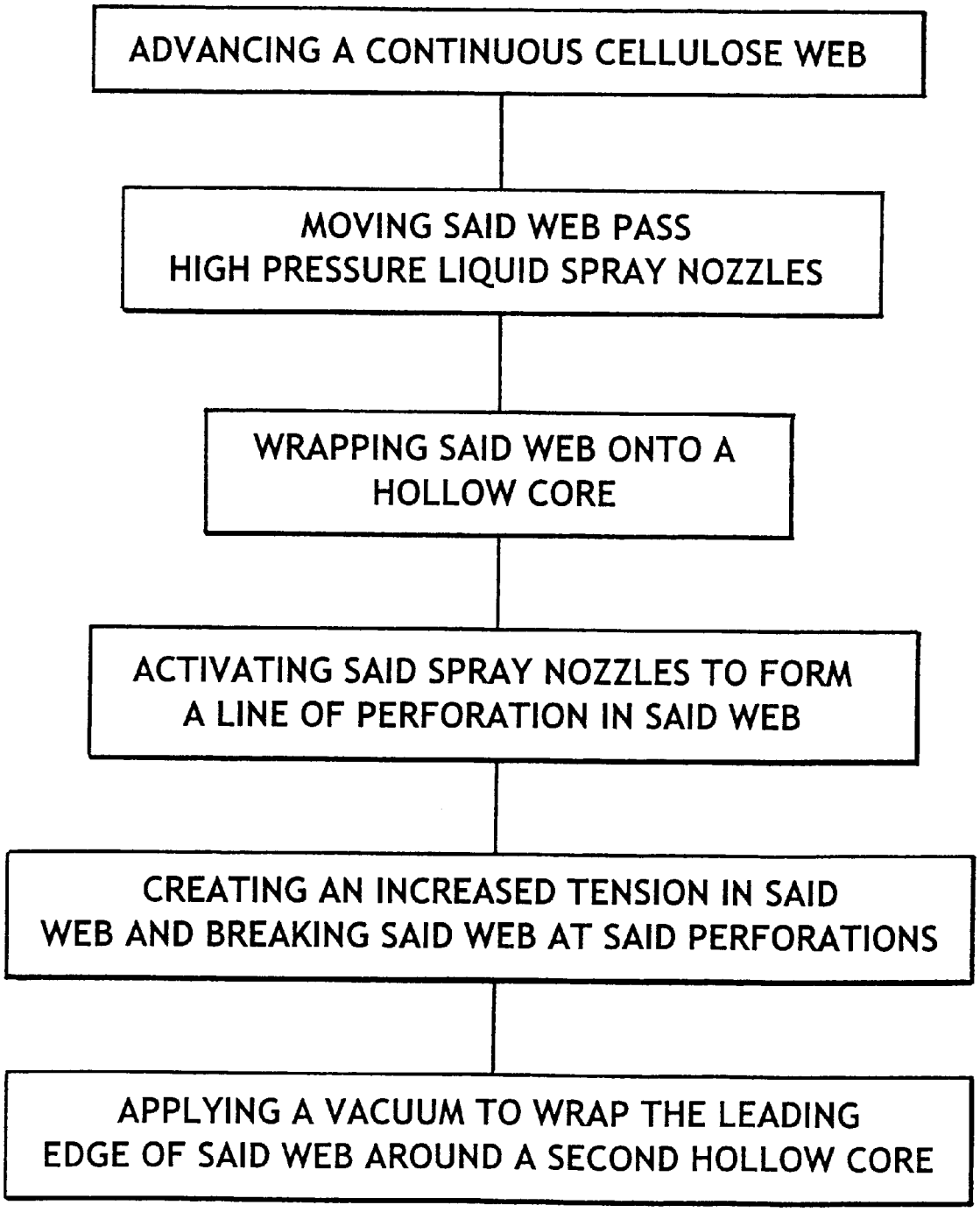
FIG. 6 is a flow diagram showing the method steps involved in cleanly breaking a continuously advancing cellulose web.

The method of cleanly breaking a continuously advancing cellulose web 12 will be explained with reference to the flow diagram depicted in FIG. 6. Using the apparatus 10 discussed above, a continuous ribbon or sheet of cellulose web 12 is advanced on a transfer fabric 14 from an upstream location 18 to a wind up zone 20. The upstream location 18 can be a Yankee dryer, a throughdryer or some other piece of equipment. The cellulose web 12 is conveyed by the transfer fabric 14 at a desired speed which preferably is constant. The transfer fabric 14 is driven by the drive roll 22. The advancing cellulose web 12 is directed pass two or more, preferably a plurality, of spray nozzles 30. The spray nozzles 30 are arranged in a line extending across the cellulose web 12 in a transverse direction. The spray nozzles 30 intermittently spray a high pressure liquid 32, such as water, onto the advancing cellulose web 12 and form a series of perforations 34 therethrough. The high pressure liquid 32 can penetrate through the cellulose web 12 but should not damage or destroy the transfer fabric 14.

The cellulose web 12 is directed by the transfer fabric 14 onto a first hollow core 50 which rotates and accumulates the advancing cellulose web 12 to form a filled or finished roll having a predetermined diameter. When the first hollow core 50 is almost filled, a signal is sent to a controller 54 which activates the spray nozzles 30 for a very short period of time, preferably about 0.01 seconds. All of the spray nozzles 30 are activated simultaneously. The high pressure liquid 32 perforates the cellulose web 12 in a predetermined pattern which extends across the width "w" of the cellulose web 12. While this is occurring, the controller 54 will send a signal to the actuator 56 which will move a second hollow core 52 into contact with the advancing hollow web 12. The second hollow core 52 will be positioned upstream of the first filled roll 50. At the same time, the assembly 56 will start to remove the first filled roll 50. The withdrawal of the first filled roll 50 and the vacuum adhesion of the second hollow core 52 creates increased tension in the cellulose web 12 and it breaks along the line of perforations 34. It should be noted that the line of perforations 34 will be located between the first and second hollow cores, 50 and 52 respectively, when the break occurs if the system is working properly.

The breaking of the cellulose web 12 creates a trailing edge 58 and a leading edge 60. The trailing edge completes the wrap of cellulose web 12 onto the first filled roll 50 while the leading edge 60 is urged toward the second hollow core 52 by a vacuum which creates a sub-atmospheric pressure. The vacuum can pass through the reel spool which firmly holds the second hollow core in position. A plurality of small apertures formed in the hollow core 52 provides conduits for the vacuum. As the leading edge 60 is sucked up against the second hollow core 52, the reel spool will rotate the hollow core and the cellulose web 12 will start to wraparound it. The assembly 56 can reposition the second hollow core 52 such that it occupies the identical position as did the first hollow core 50 when it was being filled.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A method of cleanly breaking a continuously advancing cellulose web comprising the steps of:

a) advancing said cellulose web to a wind up zone on a transfer fabric which is driven at a desired speed;

b) moving said cellulose web into contact with a high pressure liquid intermittently emanating from at least two spray nozzles aligned transversely across said cellulose web, said liquid perforating said advancing cellulose web;

c) directing said cellulose web onto a first hollow core and accumulating said cellulose web to form a filled roll;

d) activating said spray nozzles in timed sequence to the speed of said transfer fabric such that said perforations occur at a location such that said filled roll has said predetermined diameter;

e) moving a second hollow core into contact with said advancing cellulose web at a location upstream of said filled roll while simultaneously withdrawing said filled roll, said contact increasing the tension on said advancing cellulose web and causing said advancing cellulose web to cleanly break at said perforations and form a leading edge; and f) applying a vacuum to said second hollow core which causes said leading edge of said advancing cellulose web to wrap onto said second hollow core.

2. The method of claim 1 wherein said spray nozzles emit high pressure water.

3. The method of claim 2 wherein said spray nozzles emit water at a pressure above 500 pounds per square inch.

4. The method of claim 3 wherein said spray nozzles emit water at a pressure of about 1,200 pounds per square inch.

5. The method of claim 1 wherein said spray nozzles are activated simultaneously.

6. A method of cleanly breaking a continuously advancing cellulose web comprising the steps of:

a) advancing said cellulose web to a wind up zone on a closed loop transfer fabric which is driven at a desired speed;

b) moving said cellulose web into contact with a high pressure liquid emanating from a plurality of spray nozzles aligned transversely across said cellulose web, said liquid perforating said advancing cellulose web;

c) directing said cellulose web onto a first hollow core and accumulating said cellulose web to form a filled roll;

d) activating said spray nozzles in timed sequence to the speed of said transfer fabric such that said perforations occur at a location such that said filled roll has said predetermined diameter;

e) moving a second hollow core into contact with said advancing cellulose web at a location upstream of said filled roll while simultaneously withdrawing said filled roll, said contact increasing the tension on said advancing cellulose web and causing said advancing cellulose web to break at said perforations and form a leading edge; and f) applying a vacuum to said second hollow core which causes said leading edge of said advancing cellulose web to wrap onto said second hollow core.

7. The method of claim 6 wherein said cellulose web is advanced on said transfer fabric at a speed of between from about 3,000 feet per minute to about 5,000 feet per minute.

8. The method of claim 7 wherein said cellulose web is advanced on said transfer fabric at a speed of at least about 3,500 feet per minute.

9. The method of claim 6 wherein said cellulose web is advanced by said transfer fabric while being retained at an elevated temperature.

10. The method of claim 9 wherein said cellulose web is advanced by said transfer fabric while being retained at a temperature of at least about 100° F.

11. An apparatus for cleanly breaking a continuously advancing cellulose web comprising:

a) a transfer fabric which supports and advances said cellulose web to a wind up zone, said transfer fabric forming a closed loop and being driven at a desired speed by a drive roll;

b) at least two spray nozzles arranged transversely across said advancing cellulose web carried on said transfer fabric, said spray nozzles capable of emitting a liquid under high pressure against said advancing cellulose web to form perforations across the width thereof;

c) a plurality of hollow cores independently and sequentially moveable into position at said wind up zone to receive said advancing cellulose web, said hollow cores being located downstream of said spray nozzles, each of said hollow cores capable of accumulating a predetermined amount of said cellulose web;

d) control means for activating said spray nozzles in timed sequence to the speed of said transfer fabric such that a predetermined amount of cellulose web can be accumulated on each of said hollow cores to form filled rolls having a predetermined diameter;

e) assembly means for moving each of said filled rolls away from said advancing cellulose web while simultaneously moving a second hollow core into contact with said advancing cellulose web upstream of said filled roll, said contact increasing the tension on said advancing cellulose web and causing said advancing cellulose web to cleanly break at said perforations and form a leading edge; and f) vacuum means for causing said leading edge of said advancing cellulose web to wrap onto said second hollow core, said vacuum means being applied to said second hollow core.

12. The apparatus of claim 11 wherein there are a plurality of spray nozzles arranged in a line and aligned transversely across said advancing cellulose web.

13. The apparatus of claim 11 wherein each of said spray nozzles has an orifice of at least 0.04 inches in diameter.

14. The apparatus of claim 13 wherein each of said spray nozzles has an orifice of at least 0.05 inches in diameter.

15. The apparatus of claim 11 wherein each of said spray nozzles has a spray angle of at least about 90 degrees.

16. The apparatus of claim 11 wherein each of said spray nozzles has a spray angle of at least about 110 degrees.

17. An apparatus for cleanly breaking a continuously advancing cellulose web comprising:

a) a transfer fabric having an outer surface which supports and advances said cellulose web from a forming zone to a wind up zone, said transfer fabric forming a closed loop and being driven at a desired speed by a drive roll, said transfer fabric following a predetermined path around said drive roll, a reel drum and one or more guide rolls;

b) a plurality of spray nozzles arranged transversely across said advancing cellulose web, said spray nozzles capable of emitting a liquid under high pressure against said advancing cellulose web to form perforations across the width thereof;

c) a plurality of hollow cores independently and sequentially moveable into position at said wind up zone to receive said advancing cellulose web, said hollow cores being located downstream from said spray nozzles and adjacent to said reel drum, each hollow core capable of accumulating a predetermined amount of said cellulose web;

d) control means for activating said spray nozzles in timed sequence to said speed of said transfer fabric such that a predetermined amount of cellulose web can be accumulated on each hollow core to form a filled roll having a predetermined diameter;

e) assembly means for moving each of said filled rolls away from said advancing cellulose web while simultaneously moving a second hollow core into contact with said advancing cellulose web upstream of said filled roll, this contact increasing the tension on said advancing cellulose web and causing said advancing cellulose web to cleanly break at said perforations and form a leading edge; and f) vacuum means for causing said leading edge of said advancing cellulose web to wrap onto said second hollow core, said vacuum means being applied to said second hollow core.

18. The apparatus of claim 17 wherein said spray nozzles are spaced apart from one another at a distance of from between about 3 inches to about 12 inches.

19. The apparatus of claim 17 wherein each of said spray nozzles is spaced at least about 2 inches away from said advancing cellulose web.

20. The apparatus of claim 17 wherein each of said spray nozzles is spaced at least about 3 inches away from said advancing cellulose web.

* * * * *